US011242968B2

(12) United States Patent
Hou et al.

(10) Patent No.: US 11,242,968 B2
(45) Date of Patent: Feb. 8, 2022

(54) CEILING LIGHT APPARATUS

(71) Applicant: XIAMEN ECO LIGHTING CO. LTD., Xiamen (CN)

(72) Inventors: Shouqiang Hou, Xiamen (CN); Yongzhe Dong, Xiamen (CN); Xiaoliang Wen, Xiamen (CN); Wenjin Peng, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/860,044

(22) Filed: Apr. 27, 2020

(65) Prior Publication Data

US 2021/0062987 A1 Mar. 4, 2021

(30) Foreign Application Priority Data

| | | |
|---|---|---|
| Aug. 26, 2019 | (CN) | 201921395011.9 |
| Aug. 26, 2019 | (CN) | 201921400358.8 |
| Aug. 26, 2019 | (CN) | 201921400406.3 |
| Aug. 26, 2019 | (CN) | 201921400409.7 |

(51) Int. Cl.

| | |
|---|---|
| ***F21S 8/04*** | (2006.01) |
| ***F21V 21/03*** | (2006.01) |
| ***F21V 19/00*** | (2006.01) |
| ***F21V 23/00*** | (2015.01) |
| ***F21V 17/10*** | (2006.01) |
| *F21Y 115/10* | (2016.01) |

(52) U.S. Cl.

CPC ..... *F21S 8/04* (2013.01); *F21V 17/10* (2013.01); *F21V 19/004* (2013.01); *F21V 21/03* (2013.01); *F21V 23/007* (2013.01); *F21Y 2115/10* (2016.08)

(58) Field of Classification Search

CPC ..... F21V 21/03; F21S 8/04; F21S 8/046
See application file for complete search history.

(56) References Cited

U.S. PATENT DOCUMENTS

2019/0242563 A1* 8/2019 Xu ..... F21V 23/023

* cited by examiner

*Primary Examiner* — Sean P Gramling
(74) *Attorney, Agent, or Firm* — Chun-Ming Shih; Lanway IPR Services

(57) ABSTRACT

A ceiling light apparatus includes a base plate, a light passing cover, a driver and a light source module. The base plate has a center protrusion portion and a peripheral protrusion portion. In addition, the base plate has a peripheral wall. The driver is disposed in the center protrusion portion. The light source module is disposed on the front side of the base plate. The driver is disposed on the front side of the base plate.

19 Claims, 13 Drawing Sheets

Flg. 10

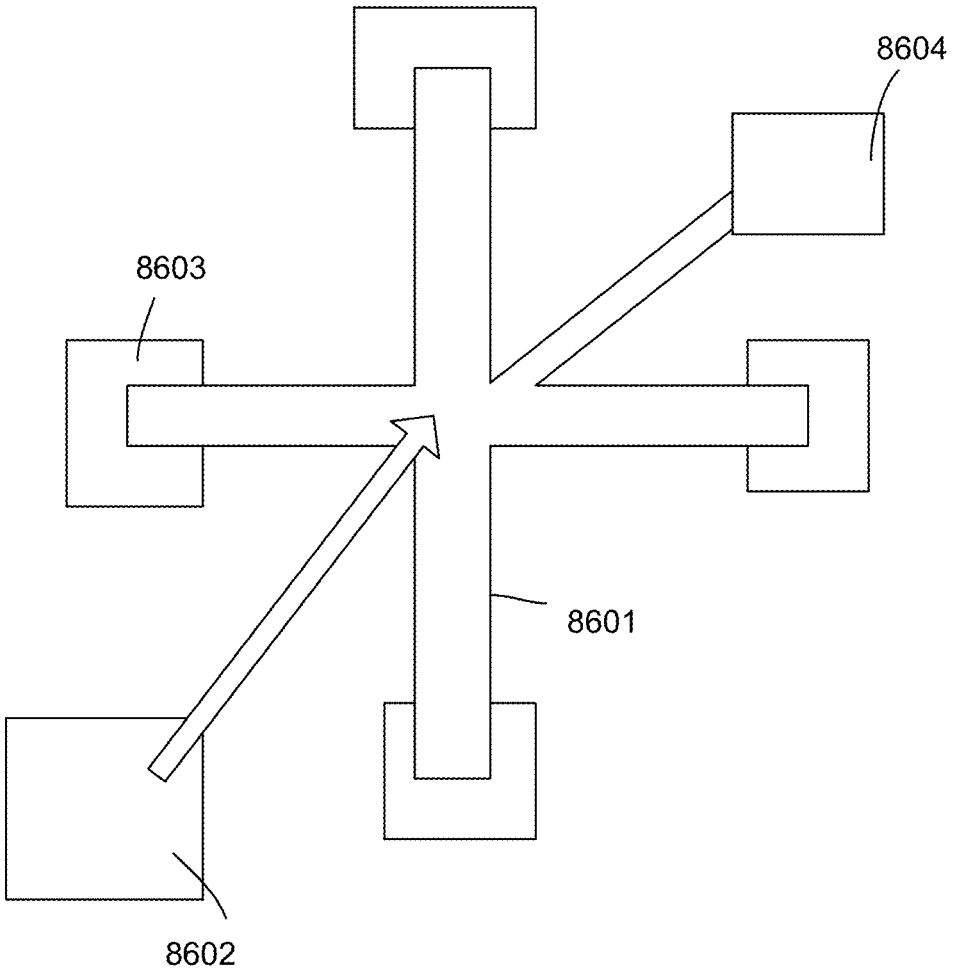
Flg. 13

CEILING LIGHT APPARATUS

FIELD

The present application is related to a lighting apparatus and more particularly related to a ceiling light apparatus.

BACKGROUND

Electroluminescence, an optical and electrical phenomenon, was discovered in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

It is also important to consider how to conveniently install a lighting apparatus. Particularly, many societies face aging problems. More and more old people need to replace or install lighting devices by themselves. Labor cost for installing lighting devices is also increasing. It is therefore beneficial to design a better way to install various lighting devices.

In some applications, it is important to project a light on an object or an area to emphasize the object or the area.

Ceiling light device are widely used in various environments. For example, various ceiling light devices are installed in bath rooms, living rooms, gallery rooms. It is beneficial and challenging to design ceiling light devices with more functions while lowering down their manufacturing cost.

SUMMARY

A ceiling light apparatus includes a base plate, a light passing cover, a driver and a light source module.

The base plate has a center protrusion portion and a peripheral protrusion portion. In addition, the base plate has a peripheral wall.

The center protrusion portion forms a center container. The peripheral protrusion portion has a connector structure for connecting to a ceiling connector. For example, the peripheral protrusion portion may have multiple connection holes for attaching to a fire prevention box pre-installed on a ceiling or another bracket pre-installed on the ceiling.

The light passing cover has the same shape as the base plate. A peripheral edge of the light passing cover is fixed to the peripheral wall of the base plate. Some fixing structures may be used for connecting the light passing cover to the base plate. In some embodiments, the fixing structures may include two rotation levers disposed on opposite sides of the base plate. By rotating the rotation levers, the light passing cover is fixed to or released from the peripheral wall of the base plate.

The driver is disposed in the center protrusion portion. The center protrusion portion is protruded from neighboring portion of the base plate and forms a concave container space. The driver sometimes has some components with larger size, e.g. capacitor for preventing flicking of LED modules. With such concave container of the center protrusion portion, the driver has sufficient space to be stored while not increasing overall thickness of the ceiling light apparatus. The center protrusion portion may have the same height as the peripheral protrusion portion.

The light source module is disposed at a same side of the base plate as the driver with a light emitting direction facing to the light passing cover. For example, the base plate has a front side and a back side. The front side is opposite to the back side. The back side is facing to the ceiling when being installed. The front side is facing downwardly to the ground. The light source module is disposed on the front side of the base plate. The driver is disposed on the front side of the base plate, too. Thus, the driver is disposed at the same side as the light source module.

In some embodiments, the connector structure of the peripheral protrusion portion of the base plate includes multiple connection holes for fixing to the ceiling connector.

In some embodiments, the ceiling light apparatus may also include a manual switch electrically connected to the driver, the manual switch is located at an external surface on the peripheral wall.

In some embodiments, the base plate has a guiding protrusion portion extended from the center protrusion portion to the peripheral wall for disposing a conductive path connecting the driver and the manual switch.

In some embodiments, where a fastening structure is used for fixing a conductive path connecting the driver and the manual switch.

In some embodiments, there is a sensor disposed adjacent to the manual switch, the sensor is connected to the driver for providing sensed data to be used by the driver.

In some embodiments, there is a wireless module disposed adjacent to the manual switch, the wireless module is connected to the driver for providing a wireless function to the driver.

In some embodiments, the ceiling light apparatus may also include a second manual switch disposed on an opposite side of the peripheral wall of the base plate, the second manual switch is connected to the driver.

In some embodiments, the second manual switch provides a same function as the manual switch.

In some embodiments, the ceiling light apparatus may also include a third manual switch located on an opposite side of the center protrusion portion as the driver.

In some embodiments, the center protrusion portion and the peripheral protrusion portion are formed by stamping a metal plate.

In some embodiments, the light source module includes multiple light source units.

In some embodiments, each light source unit includes a U-shape substrate mounted with LED modules.

In some embodiments, the base plate has clips for fixing the multiple light source units.

In some embodiments, the clips provide electrical connections to the driver.

In some embodiments, the light passing cover includes multiple lens respectively cover the multiple light source units.

In some embodiments, the base plate has clips for fixing the multiple light source units and the clips are manually rotatable by a user for adjusting an output light angle of corresponding light source unit.

In some embodiments, the light source module is a ring shape light source.

In some embodiments, the ceiling light apparatus may also include a conductive layer fixed to the base plate for providing electricity connection between the driver and the light source module.

In some embodiments, the peripheral wall includes an attaching connector for detachably fixing an outer decoration ring.

BRIEF DESCRIPTION OF DRAWINGS

FIG. 13 shows a conductive layer used for connecting components.

DETAILED DESCRIPTION

Figure 1:
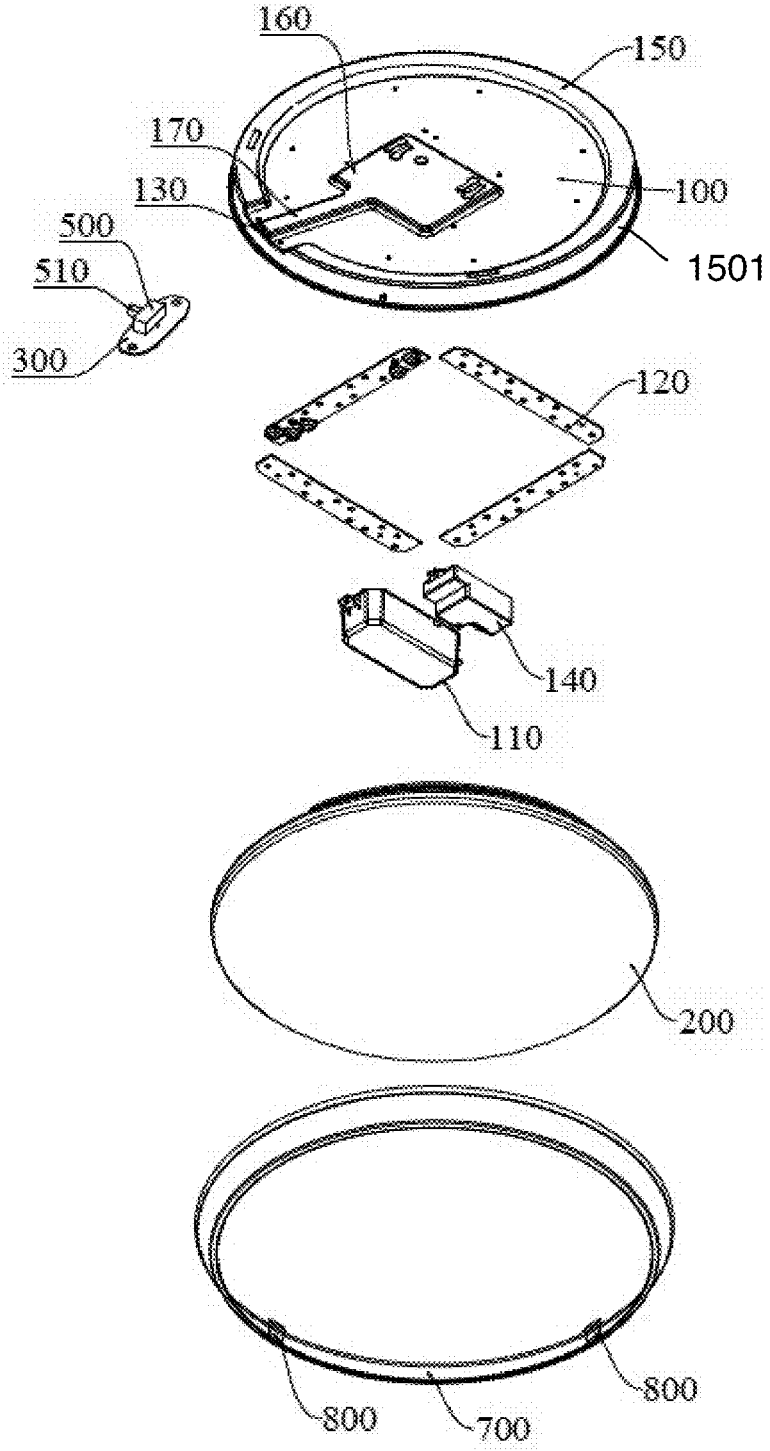
FIG. 1 illustrates an exploded view of a ceiling light apparatus.
Figure 2:
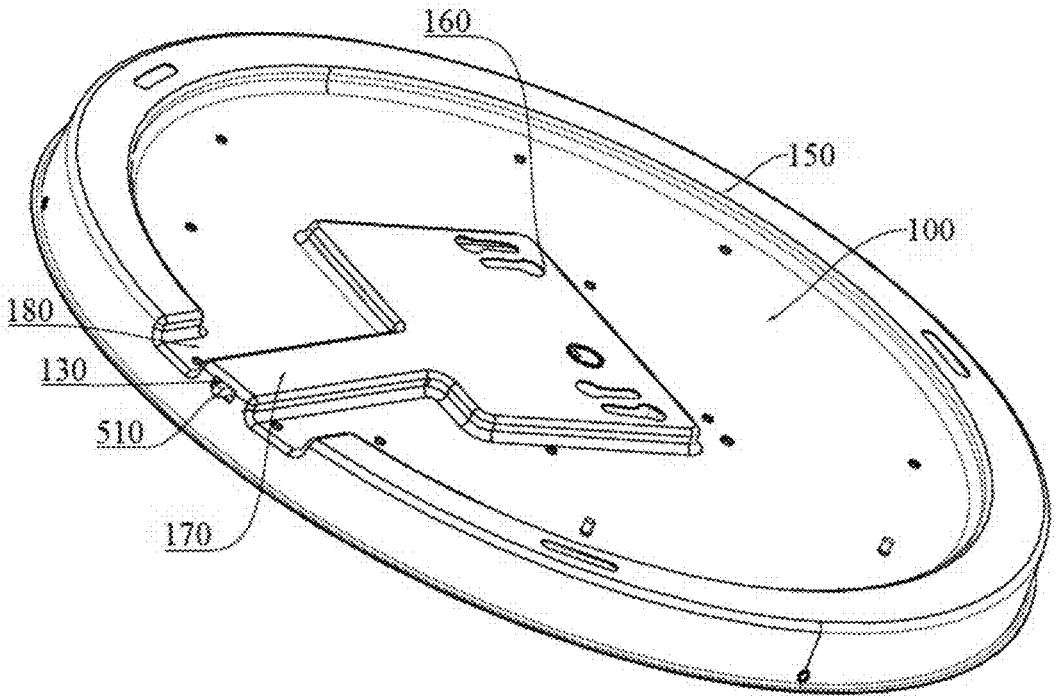
FIG. 2 illustrates a base plate example.

Please refer to FIG. 1 and FIG. 2. A ceiling light apparatus includes a base plate 100, and a light passing cover 200 attachable connected to the base plate 100.

The base plate 100 has a driver 110 and a light source module 120 electrically connected to the driver 110. The driver 110 and the light source module 12 are fixed to a front of the base plate 100.

A printed circuit board 300 is fastened connected to an edge of the base plate 100. The printed circuit board 300 is connected to the driver 110 through a conductive path like a conductive wire.

The front side of the base plate 100 has a fastening structure 400 for positioning the conductive path connecting the printed circuit board 300 and the driver 110. A color temperature switch 500 is welded on the printed circuit board 300. The color temperature switch 500 is an example of a manual switch. In other words, the manual switch may be replaced with other functions on adjusting parameters of the driver, e.g. to change color of the light source module, to change operation mode of the light source module.

The base plate 100 has a peripheral wall 1501. The color temperature switch 500 is exposed on surface of the peripheral wall 1501, e.g. via a side hole 130 on the peripheral wall 1501 of the base plate 100. An operating portion 510 of the color temperature switch 500 passes through the side hole 130 reaching outside the ceiling light apparatus.

When adjusting the color temperature, the user may switch the operating portion 510 of the color temperature switch 500 outside the ceiling light apparatus to change a level of the color temperature for an adjustment.

The operating portion 510 is fixed outside the color temperature switch 500 for a user to switch for the adjustment to the color temperature, such as a push button, a switch bar, or a rotated button. In addition, the operating portion 510 of the color temperature switch 500 that may receive a remote signal also considered as a signal receiving portion.

The user may control the operating portion 510 of the color temperature switch 500 for adjusting the color temperature without taking off the light passing cover 200. The printed circuit board 300 receives a signal and passes to the driver 110, then the driver 110 control the related light source 123 of the light source module 120 for adjusting the color temperature.

The ceiling light apparatus of an embodiment changes a traditional ceiling light apparatus from which the color temperature switch 500 is directly connected to the driver 110 fixed between the space of the light passing cover 200 and the base plate 100.

In an embodiment, the color temperature is fixed to the edge of the base plate 100 and has a side hole 130 on the side wall of the base plate 100 related to the operating portion 510 of the color temperature switch 500 for the operating portion 510 of the color temperature switch 500 reaching outside through the side hole 130.

The user may adjust the color temperature by switching the operating portion 510 of the color temperature switch 500 without taking off the light passing cover 200 which makes the operation of the adjustment of the color temperature more convenient and efficient.

In an embodiment, a fastening structure 400 is used for fastening the conductive wire and the base plate 100 to lower down the influence of the conductive wire unwillingly hanging which makes the connection between the conductive wire and the printed circuit board 300 or the driver 110 stable.

The connection between the color temperature switch and the driver 110 is still stable even when changing the position of the color temperature switch 500 that assures the adjustment of the color temperature without being affected by a movement of the color temperature switch.

More particularly, the base plate 100 includes a main body and a ring side wall connected to the peripheral side of the main body. The side hole 130 is at an end of the ring side wall closed to the end of the main body of the base plate. The light passing cover 200 and another end of the ring side wall is connected and attachable. The color temperature switch may be a boat type switch, a dialing switch, an electrodeless switch or a drawbench switch . . . etc., which the embodiment is not limited.

In an embodiment, the light passing cover 200 and the base plate 100 may be connected by thread, socket, undirected connections, or any other detachable connecting methods. Among them, the connecting part may be a bolt, a buckle or other device which stably connects the light passing cover 200 and the base plate 100 in a related position.

The light passing cover 200 may be made of a good light transmitting, a fire preventing, a corrosion preventing plastic materials or glass. The weight of the ceiling light apparatus is lighter and is more easily to transported and installed while using plastic materials. The fastening structure 400 may use something detachably connected to the base plate 100 such as a hook, a line clip, a line card or a line slot for fastening the conductive wire and the base plate 100 in a related position.

Figure 3:
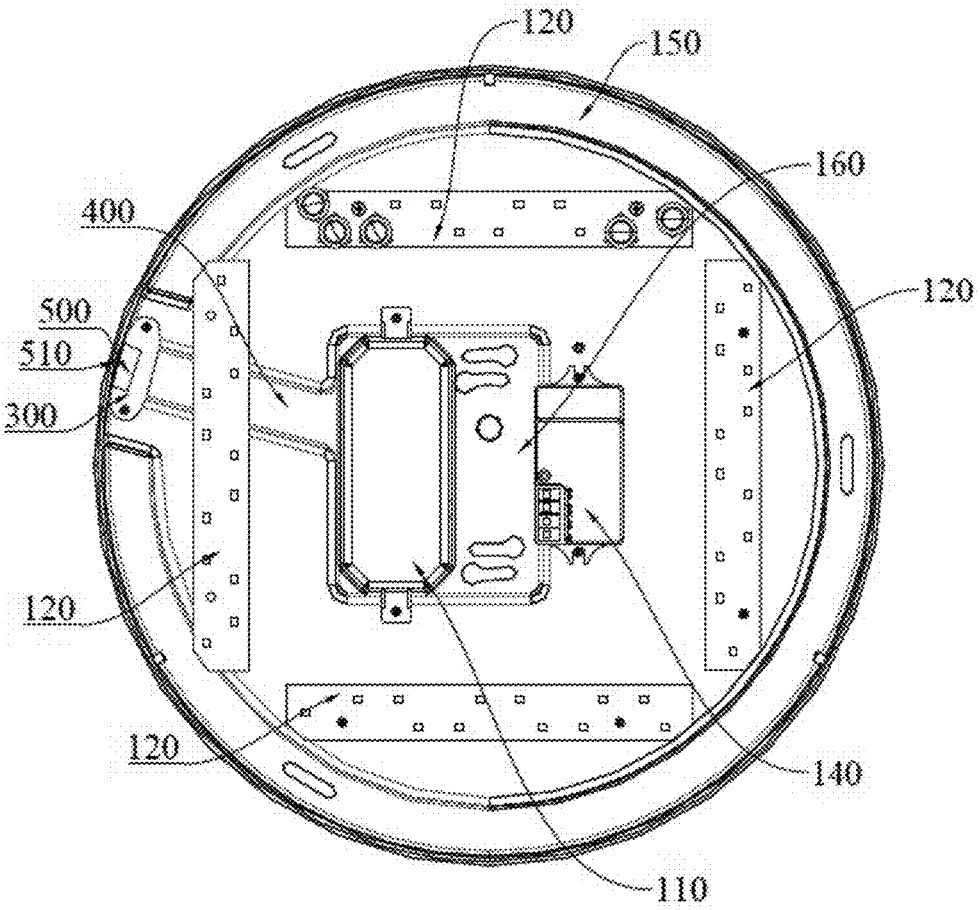
FIG. 3 illustrates a front side of the base plate example.
Figure 6:
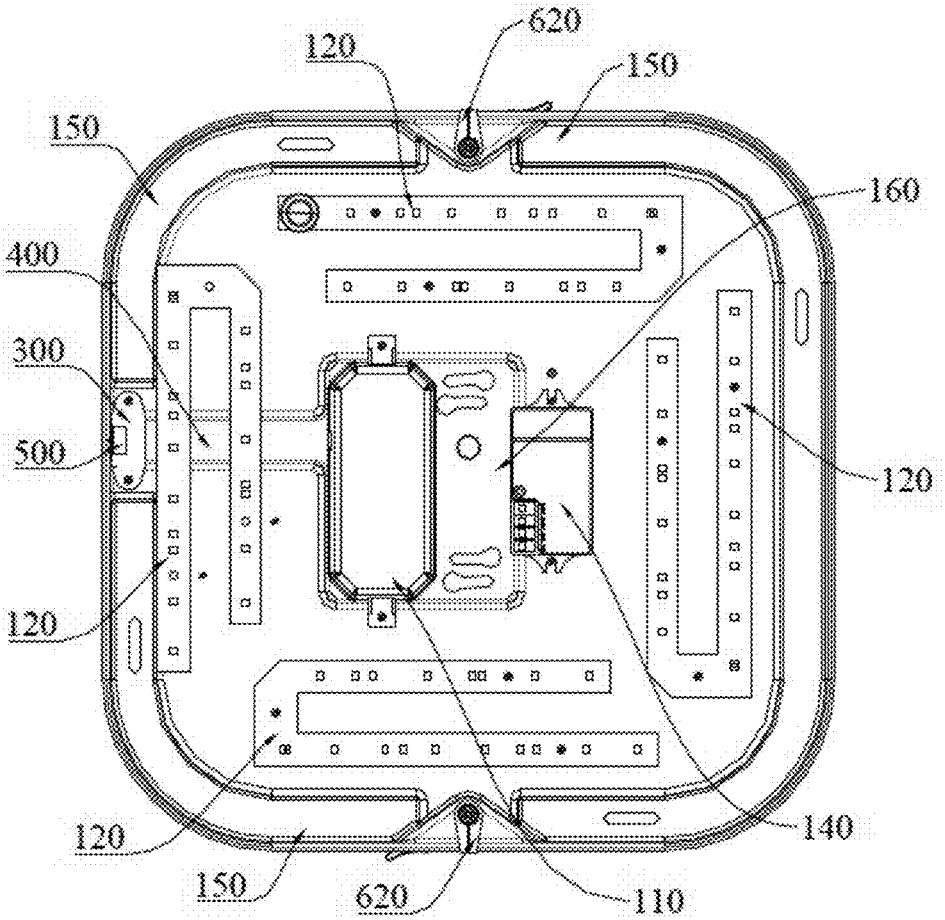
FIG. 6 illustrates another view of the base plate example of FIG. 4.

Please refer to FIG. 1, FIG. 3 and FIG. 6 for a more intelligent ceiling light apparatus. In an embodiment, the base 100 has a control module 140. The control module 140 has a Bluetooth device and a WiFi device power connected the driver 110, the light source module 120 and the printed circuit board 300.

The setting of the control module 140 provides the color temperature, the brightness and switching on or switching off being controlled by an external remote device through remoting. The external remote device includes computers, handheld devices, or wearable devices, handheld devices may be phones or laptops, wearable devices may be bracelets or watches. The external remote device may be Bluetooth pairing or WIFI connecting to the ceiling light apparatus when the user needed to change a working mode. The control module 140 may be selected in the market and the program in the control module 140 may be edited according to the necessity of the user.

Please refer to FIG. 1 to FIG. 6. The peripheral surface of the base plate 100 has a first installation base 150 setting protruding up for connecting to a ceiling. In the middle part of the base plate 100 has a second installation base 160 protruding up for connecting to a fire prevention box. The first installation base 150 and a second installation base 160 are a hollow structure and bottom opening. The second installation base 160 has a chamber for containing the driver 110.

Specifically, the first installation base 150 and the second installation base 160 each have bolt mounting holes. When the user installed the ceiling light apparatus to the ceiling, the user inputs a bolt into an installed hole on the first installation base 150, and the bolt is connected the first installation base 150 and the ceiling for fastening the ceiling light apparatus to the ceiling.

When the user needed to connect a fire prevention box, the user puts the connection part of the ceiling light apparatus and the fire prevention box into the installed hole of the second installation base 160 for fastening the connection of the ceiling light apparatus and the fire prevention box. In addition, an inner surface of the second installation base 160 is formed on the base plate 100 for containing the driver 110 for transfer a heat from the driver 110 through the second installation base 160 when installed to the base plate 100 that increases the heat dissipation of the ceiling light apparatus.

Please refer to FIG. 3 and FIG. 6. The fastening structure 400 is a wire groove for containing the conductive wire. The wire groove has an end connected to the chamber and another end reaches to the top of the printed circuit board 300 connecting to the side hole 130. The conductive wire between the driver 110 and the printed circuit board 300 is placed in the wire groove for providing a neat wire for conveniently installing the light passing cover 200.

Figure 4:
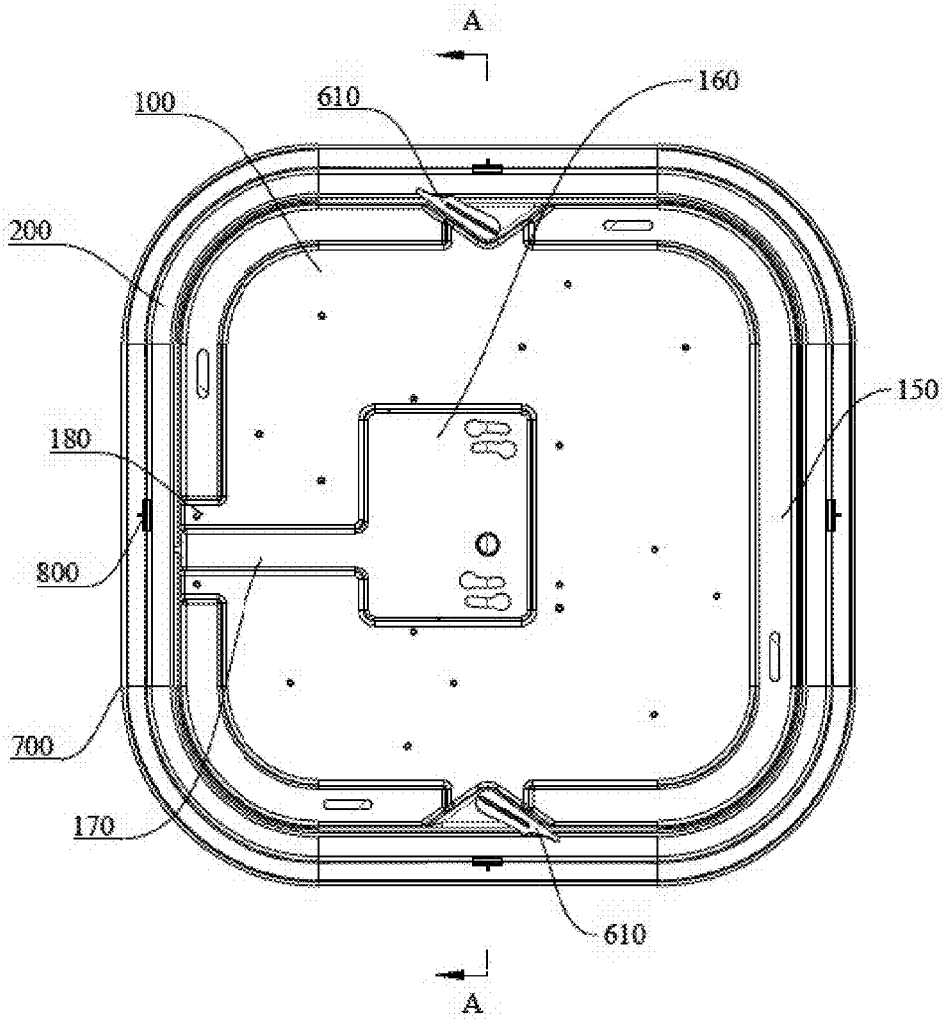
FIG. 4 illustrates another base plate example.
Figure 5:
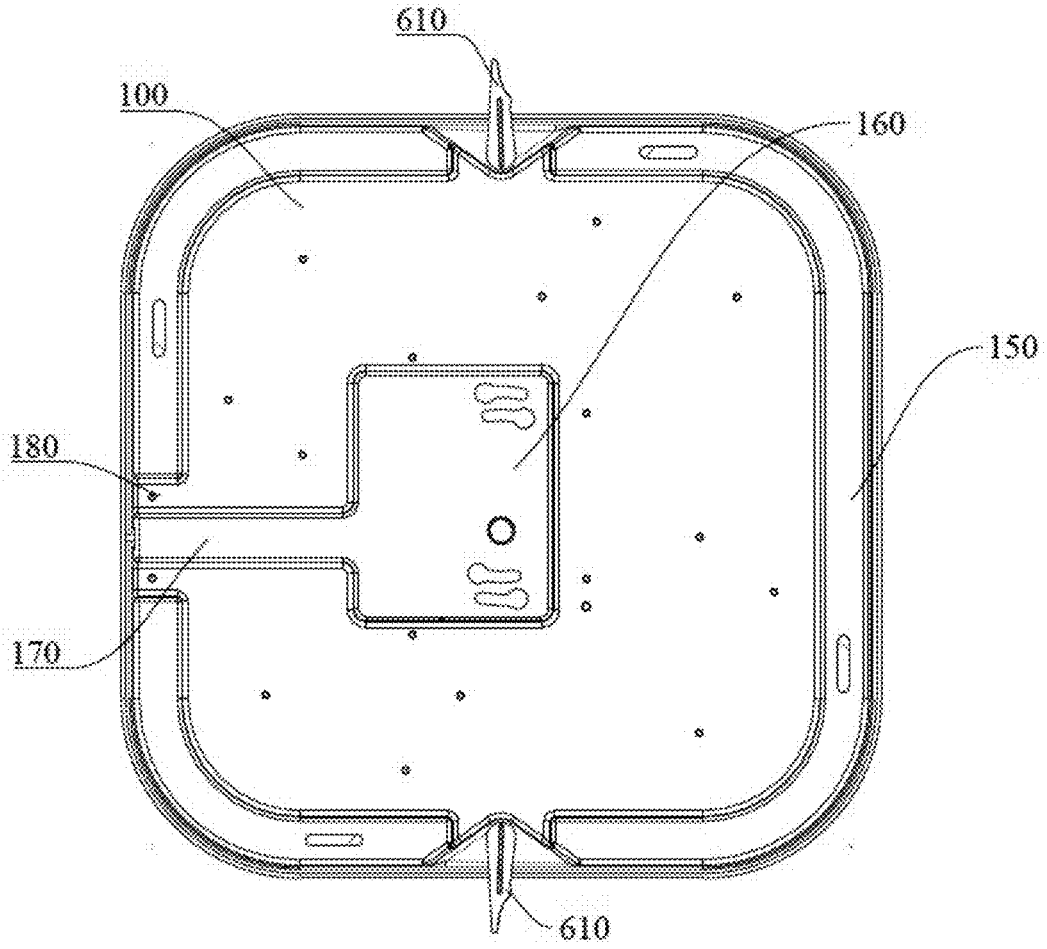
FIG. 5 illustrates another view of the base plate example of FIG. 4.

Please refer to FIG. 1, FIG. 2 and FIG. 4. The first installation base is a curved shape forming an opened ring with a gap 180. An external surface of the wire groove protruding out forms a protruding platform. The protruding platform has an end connected to the second installation base 160, and another end stretches into the inner side of the gap 180. The setting of the gap 180 is for an air may flow into the base plate 100 from the gap 180 for cooler down the ceiling light apparatus for a better heat dissipation when the ceiling light apparatus is installed to the ceiling.

Figure 7:
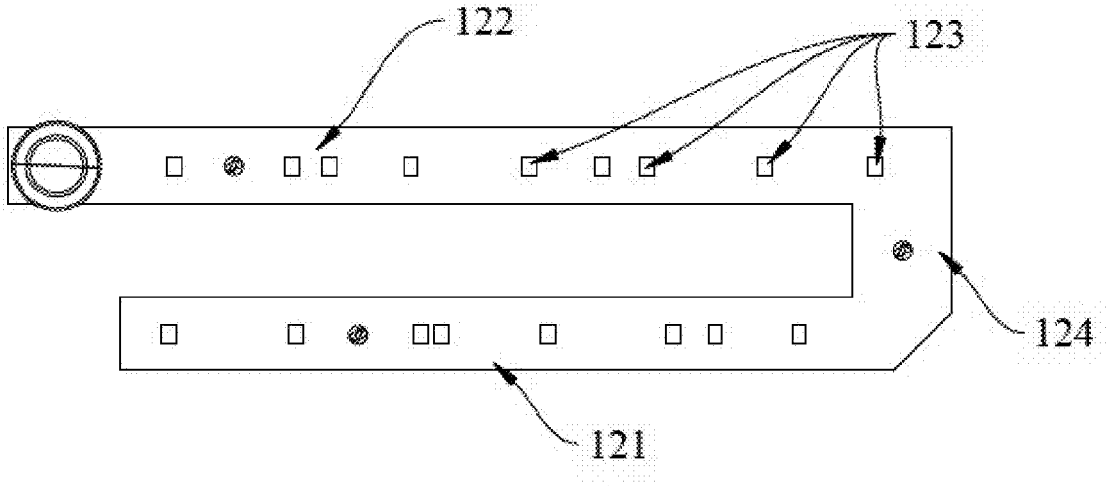
FIG. 7 illustrates a U-shape light source unit.
Figure 8:
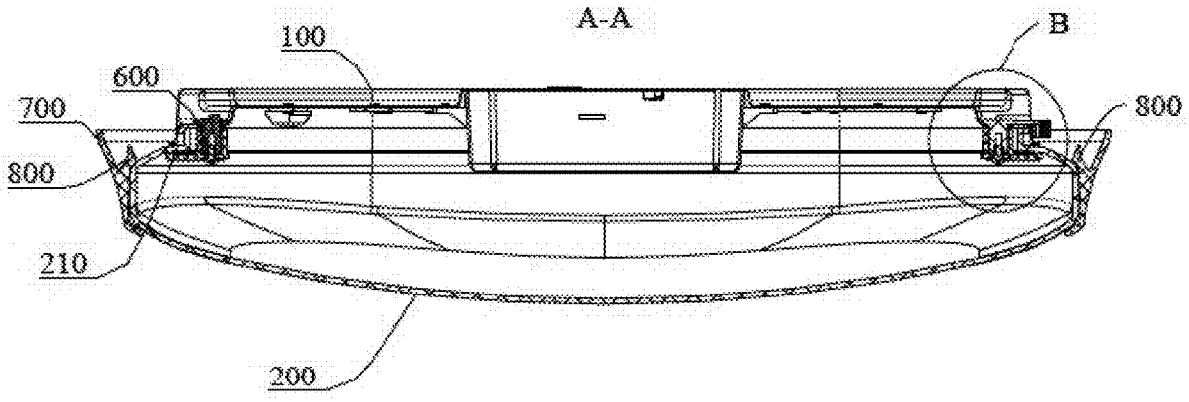
FIG. 8 illustrates a side view of a ceiling light apparatus.

Please refer to FIG. 7, the light source module 120 includes four first aluminous base boards 121 surrounding the driver 110, four second aluminous base boards 122 related to the four first aluminous base boards 121, and multiple light sources 123 on the first aluminous base boards 121 and the second aluminous base boards 122. The first aluminous base boards 121 is parallel to the related second aluminous base boards 122. The second aluminous base boards 122 is outside the first aluminous base boards 121. The first aluminous base boards 121 and the second aluminous base boards 122 form a U-shaped aluminous base board through a connection of third aluminous base boards 124. A space is between the two adjacent U-shaped aluminous base board for passing the heat of the U-shaped aluminous base board for providing the light source module 120 a better heat dissipation to assure a longer life span and a stable working ability of the ceiling light apparatus.

Specifically, the U-shaped aluminous base board is a one molding structure that may be cut from a large size aluminum board or by directly concreting or ramming, in order to increase the stable connection between the first aluminous base boards 121, the second aluminous base boards 122 and the third aluminous base boards 124. A connecting end of the third aluminous base board and the first aluminous base board is a shape of triangle for a smaller space between two adjacent U-shaped aluminous board that provides an equal brightness of each district of the ceiling light apparatus. In order to increase the equality of the light emitting out from the light source module 120, a semicircle lens structure is fixed outside the light source 123 for increase the light emitting area.

Please refer to FIG. 4, FIG. 6, FIG. 8 and FIG. 9. The ceiling light apparatus also includes a buckle connected unit 600. The light passing cover 200 and the base plate 100 detachably connected to each other through the buckle connected unit. Each of the buckle connected unit is rotated connected to the base plate 100 with a locked mode and an unlocked mode. The top of the light passing cover 200 has a first connecting portion 210 connected to the base plate 100. Each of the buckle connected unit 600 includes a driving portion 610 on the base plate 100, a supporting portion 620 at the bottom of the first connecting portion 210, and a second connecting portion 630 with an end connected to the driving portion 610 and an end connected to the supporting portion 620. The second connecting portion passes through the base plate 100 and matches the rotation of the base plate 100. The driving portion 610 may rotate the supporting portion 620 and the related first connecting portion through the second connecting portion 630.

In an embodiment, when the buckle connected unit 600 is in a locked mode, the supporting portion 620 rotates to the bottom of the first connecting portion 210 by the drive of the driving portion 610 for supporting the first connecting portion 210 and adding a pressure from the first connecting portion 210 to the base plate 100. The first connecting portion 210 under the pressure of the supporting portion 620 fitted to the base plate 100. When the buckle connected unit 600 is in an unlocked mode, the supporting portion 620 rotates to a side of the first connecting portion 210 through the drive of the driving portion 610 and disconnected with the first connecting portion 210.

When the user installs a ceiling light apparatus, buckle up the base plate 100 and the light passing cover 200 together, then rotate the driving portion 610 for bring the supporting portion 620 rotates to the direction of the first connecting portion 210 until the supporting portion 620 rotates to the bottom of the first connecting portion 210 which provide a support to the first connecting portion 210 on the light passing cover 200. Meanwhile, the supporting portion 620 provides a support to the first connecting portion 210, but also adds a pressure from the first connecting portion 210 to the base plate 100 and the first connecting portion 210 fitted to the base plate 100 under the support of the supporting portion 620. When the user needs to detach the light passing cover 200, the user rotates another way of the driving portion 610 for departing the supporting portion 620 from the first connecting portion 210 until the supporting portion 620 departed from the first connecting portion 210. Meanwhile, the light passing cover may be taken off the base plate 100.

The base plate 100 and the light passing cover 200 are connected together when the buckle connected unit is locked up for avoiding the dust getting into the ceiling light apparatus by seams which provides the ceiling light apparatus a longer life span and a stable working ability. In addition, the buckle connected unit 600 switches the locked mode and the unlocked mode by rotation to be less breakable when using. Specifically, the driving portion 610 and the supporting portion 620 are respectively a board, the driving portion 610 and the supporting portion 620 respectively has an end connected to the second connecting portion 630 and an end as an active end.

The second connecting portion 630 vertically passes through the base plate 100 matching the rotation of each other. The driving portion 610 through the second connecting portion 630 is attachable and connects to the supporting portion 620 for the convenience of replacing and repairing the buckle connected unit 600.

Figure 9:
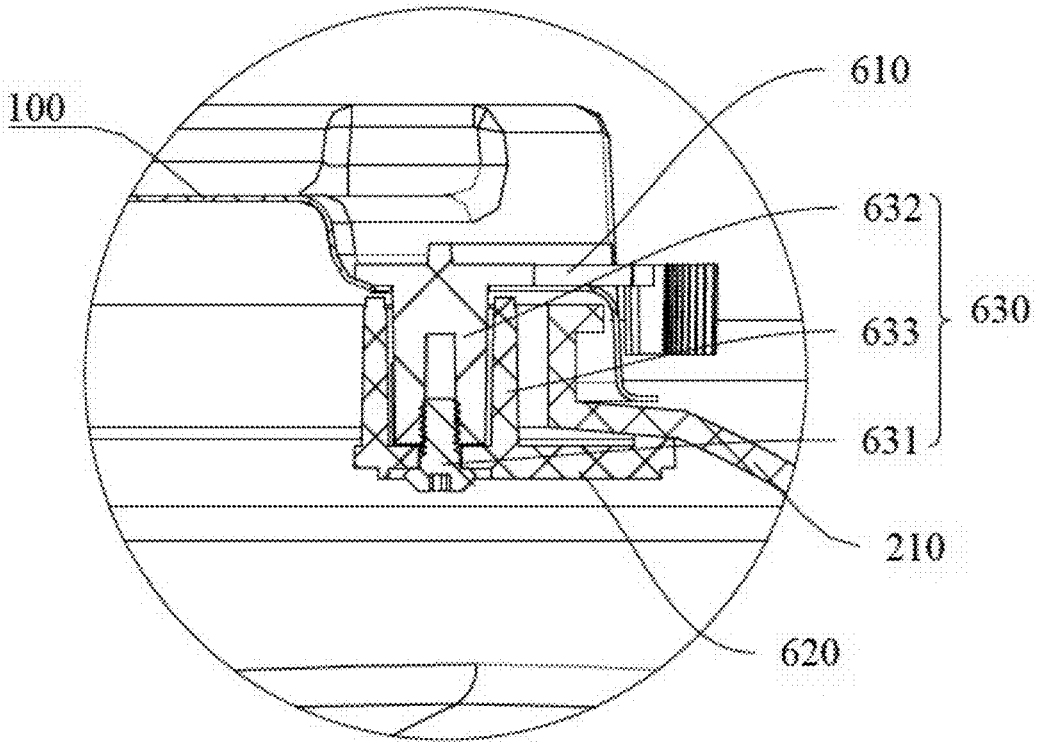
FIG. 9 illustrates a connector structure.

Please refer to FIG. 9. The second connecting portion 630 includes an attachable connecting bridge 631 connected to respectively to the driving portion 610 and the supporting portion 620. The connecting bridge 631 provides an attachable connection between the driving portion 610 and the supporting portion 620 for the convenience for the user to take of the buckle connected unit 600 from the base plate 100 and the convenience of the replacement and repairing of the buckle connected unit 600. The connecting bridge 631 may have an end screw connected to the driving portion 610 and an end which is a bolt, or a screw bar connected to the supporting portion 620.

Please refer to FIG. 9. The second connecting portion also includes a first sleeve tube 632 and a second sleeve tube 633 socket connected to each other. The first sleeve tube 632 is fixed at the bottom of the driving portion 610. The second sleeve tube 633 is fixed at the top of the supporting portion 620. The second sleeve tube 633 is fixed outside the first sleeve tube 632. The connecting bridge 631 is screw connected to the supporting portion 620 and the first sleeve tube 632.

In an embodiment, the first sleeve tube 632 and the second sleeve tube 633 is connected outside the connecting bride 631 as a smooth housing. The connecting surface of the second connecting portion and the base plate is smooth enough for decreasing the friction between the second connecting portion 630 and the base plate 100 which assures the buckle connected unit 600 to rotate smoothly.

In an embodiment, in order to the requirement of a better appearance, a decorating ring surface 700 which is attachable may be installed outside the light passing cover 200. Please refer to FIG. 1, FIG. 4 and FIG. 8. The decorating ring surface 700 have multiple colors and may be plastic or metal based on the need of the user. The decorating ring surface may buckle, socket connect, or else to the light passing cover 200.

Specifically, an inner surface of decorating ring surface 700 has a buckle 800 for connecting to an external surface of the light passing cover 200 for the convenience of installation. The amount of the buckle 800 may be at least two or more depending on the need of the user, providing a stable connection to the light passing cover 200. When there are two buckles 800, the two buckles 800 may be set on the two opposite sides of the decorating ring surface 700 to ensure a balance on both sides. When the amount of the buckle 800 is more than two, the buckle 800 may be installed in an equal distance on the decorating ring surface 700.

The buckle 800 and the decorating ring surface 700 is molded in one to ensure the connection is stable between the buckle 800 and the decorating ring surface 700. The buckle 800 and the decorating ring surface 700 may be made of plastic for a lighter weight, a convenient installation, and a cheaper price for marketing.

Figure 10:
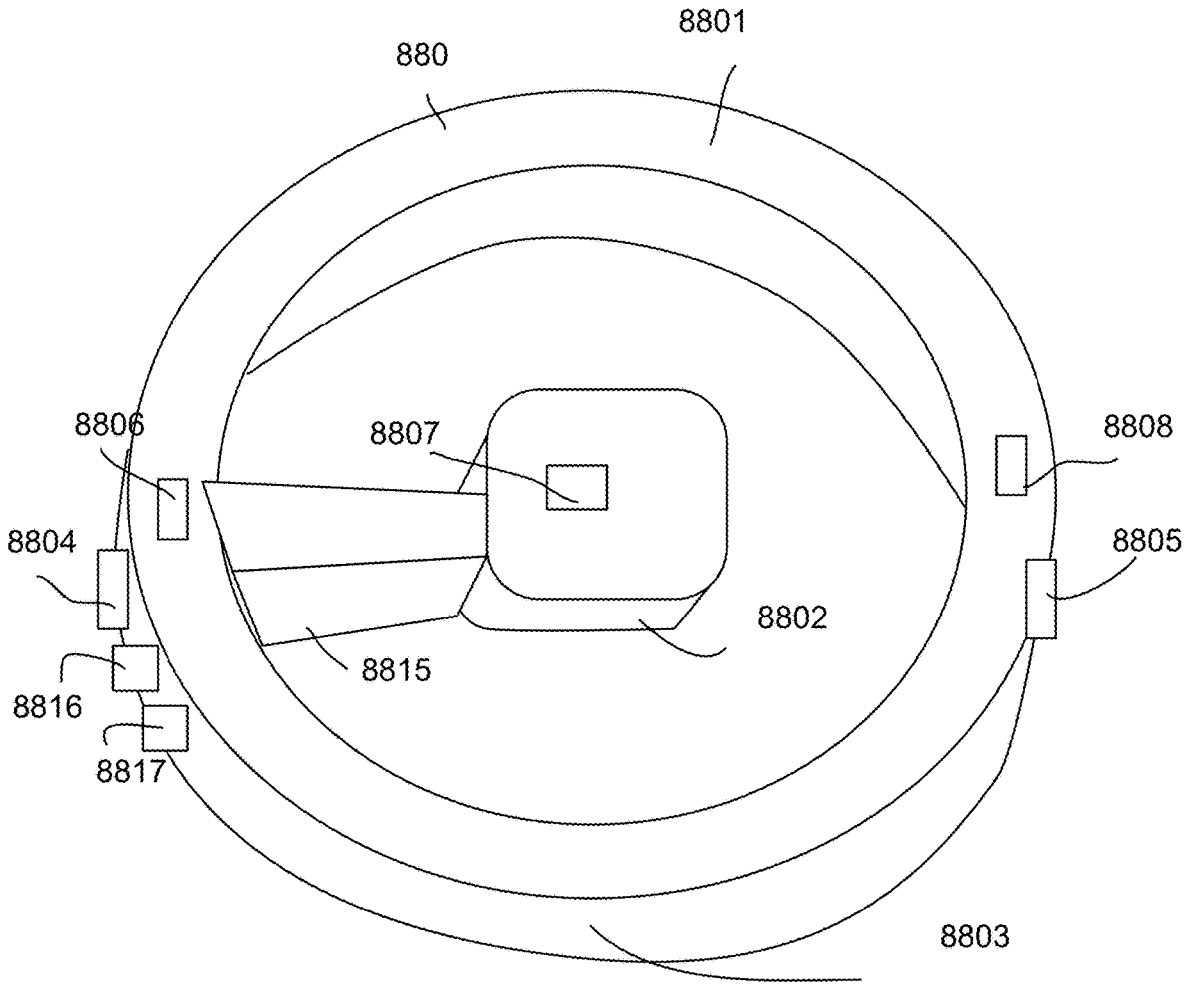
FIG. 10 illustrates a structure diagram of a ceiling light apparatus.

In FIG. 10, A ceiling light apparatus includes a base plate 880, a light passing cover, a driver and a light source module.

The base plate 880 has a center protrusion portion 8802 and a peripheral protrusion 8801 portion. In addition, the base plate has a peripheral wall 8803.

The center protrusion portion 8802 forms a center container. The peripheral protrusion portion 8801 has a connector structure 8806, 8808 for connecting to a ceiling connector. For example, the peripheral protrusion portion 8801 may have multiple connection holes for attaching to a fire prevention box pre-installed on a ceiling or another bracket pre-installed on the ceiling.

The light passing cover has the same shape as the base plate. A peripheral edge of the light passing cover is fixed to the peripheral wall of the base plate. Some fixing structures may be used for connecting the light passing cover to the base plate. In some embodiments, the fixing structures may include two rotation levers disposed on opposite sides of the base plate. By rotating the rotation levers, the light passing cover is fixed to or released from the peripheral wall of the base plate.

The driver is disposed in the center protrusion portion 8802. The center protrusion portion 8802 is protruded from neighboring portion of the base plate and forms a concave container space. The driver sometimes has some components with larger size, e.g. capacitor for preventing flicking of LED modules. With such concave container of the center protrusion portion, the driver has sufficient space to be stored while not increasing overall thickness of the ceiling light apparatus. The center protrusion portion may have the same height as the peripheral protrusion portion.

The light source module is disposed at a same side of the base plate as the driver with a light emitting direction facing to the light passing cover. For example, the base plate has a front side and a back side. The front side is opposite to the back side. The back side is facing to the ceiling when being installed. The front side is facing downwardly to the ground. The light source module is disposed on the front side of the base plate. The driver is disposed on the front side of the base plate, too. Thus, the driver is disposed at the same side as the light source module.

In some embodiments, the connector structure of the peripheral protrusion portion of the base plate includes multiple connection holes for fixing to the ceiling connector.

In FIG. 10, the ceiling light apparatus may also include a manual switch 8804 electrically connected to the driver, the manual switch 8804 is located at an external surface on the peripheral wall 8803.

In FIG. 10, the base plate has a guiding protrusion portion 8815 extended from the center protrusion portion 8802 to the peripheral wall 8803 for disposing a conductive path connecting the driver and the manual switch 8804.

In some embodiments, where a fastening structure is used for fixing a conductive path connecting the driver and the manual switch.

In FIG. 10, there is a sensor 8816 disposed adjacent to the manual switch 8804, the sensor 8816 is connected to the driver for providing sensed data to be used by the driver.

In FIG. 10, there is a wireless module 8817 disposed adjacent to the manual switch 8804, the wireless module 8817 is connected to the driver for providing a wireless function to the driver.

In FIG. 10, the ceiling light apparatus may also include a second manual switch 8805 disposed on an opposite side of the peripheral wall 8803 of the base plate, the second manual switch 8805 is connected to the driver.

In some embodiments, the second manual switch provides a same function as the manual switch.

In some embodiments, the ceiling light apparatus may also include a third manual switch 8807 located on an opposite side of the center protrusion portion 8807 as the driver.

In some embodiments, the center protrusion portion and the peripheral protrusion portion are formed by stamping a metal plate.

In some embodiments, the light source module includes multiple light source units.

Figure 11:
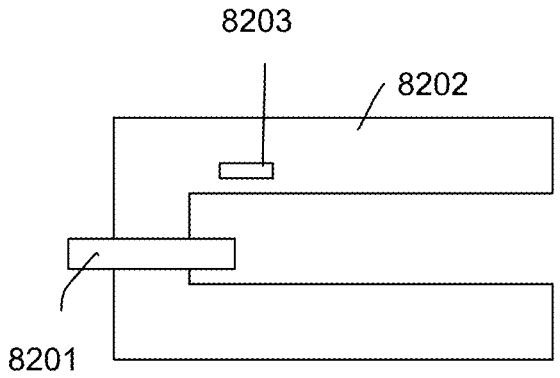
FIG. 11 illustrates a U-shape light source piece example.
Figure 12:
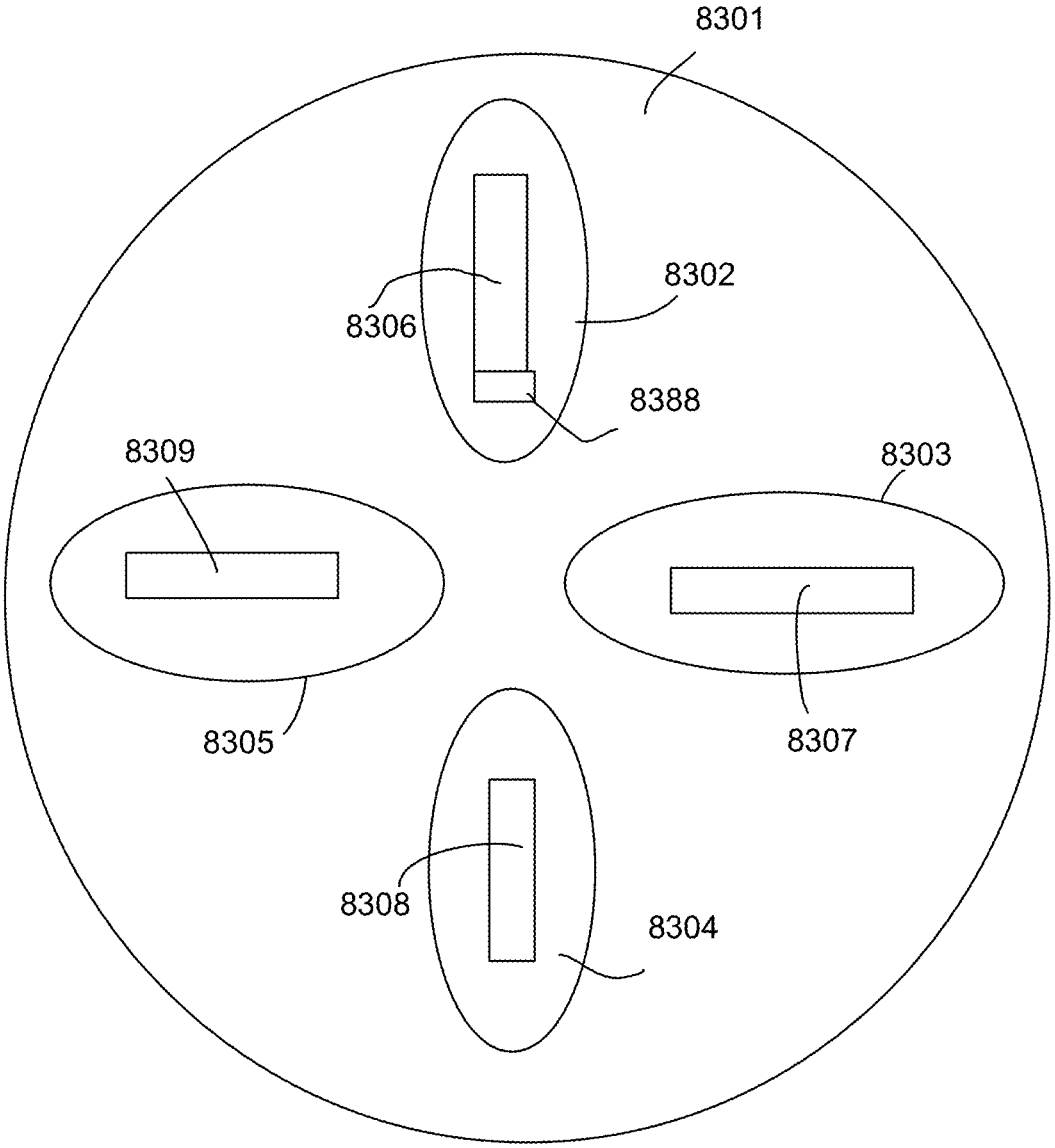
FIG. 12 shows another light passing cover example with corresponding light source units.

In FIG. 11, each light source unit includes a U-shape substrate 8202 mounted with LED modules 8203.

In FIG. 11, the base plate has clips 8201 for fixing the multiple light source units 8202.

In some embodiments, the clips provide electrical connections to the driver.

In FIG. 13, the light passing cover includes multiple lens 8302, 8303, 8304, 8305 respectively cover the multiple light source units 8306, 8307, 8308, 8309.

In FIG. 13, the base plate has clips 8388 for fixing the multiple light source units 8306, 8307, 8308, 8309 and the clips are manually rotatable by a user for adjusting an output light angle of corresponding light source unit.

In some embodiments, the light source module is a ring shape light source.

In FIG. 13, the ceiling light apparatus may also include a conductive layer 8601 fixed to the base plate for providing electricity connection between the driver 8602 and the light source module 8603. Such conductive layer 8601 includes multiple conductive paths for transmitting power signals and/or control signals from the driver 8602 to light source modules 8603 and the manual switch 8604. In such design, no wire is necessary. In addition, the conductive layer 8601 may include multiple sockets for directly plugging to connect the components of the ceiling light apparatus.

In some embodiments, the peripheral wall includes an attaching connector for detachably fixing an outer decoration ring.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A ceiling light apparatus, comprising:

a base plate with a center protrusion portion, a peripheral protrusion portion and a peripheral wall, the center protrusion portion forming a center container, the peripheral protrusion portion having a connector structure for connecting to a ceiling connector;

a light passing cover with a same shape as the base plate and a peripheral edge of the light passing cover being fixed to the peripheral wall of the base plate;

a driver disposed in the center protrusion portion;

a light source module disposed at a same side of the base plate as the driver with a light emitting direction facing to the light passing cover; and a manual switch electrically connected to the driver, wherein the manual switch is located at an external surface on the peripheral wall.

2. The ceiling light apparatus of claim 1, wherein the connector structure of the peripheral protrusion portion of the base plate comprises multiple connection holes for fixing to the ceiling connector.

3. The ceiling light apparatus of claim 1, wherein the base plate has a guiding protrusion portion extended from the center protrusion portion to the peripheral wall for disposing a conductive path connecting the driver and the manual switch.

4. The ceiling light apparatus of claim 1, where a fastening structure is used for fixing a conductive path connecting the driver and the manual switch.

5. The ceiling light apparatus of claim 1, wherein there is a sensor disposed adjacent to the manual switch, the sensor is connected to the driver for providing sensed data to be used by the driver.

6. The ceiling light apparatus of claim 1, wherein there is a wireless module disposed adjacent to the manual switch, the wireless module is connected to the driver for providing a wireless function to the driver.

7. The ceiling light apparatus of claim 1, further comprising a second manual switch disposed on an opposite side of the peripheral wall of the base plate, the second manual switch is connected to the driver.

8. The ceiling light apparatus of claim 7, wherein the second manual switch provides a same function as the manual switch.

9. The ceiling light apparatus of claim 7, further comprising a third manual switch located on an opposite side of the center protrusion portion as the driver.

10. The ceiling light apparatus of claim 1, wherein the center protrusion portion and the peripheral protrusion portion are formed by stamping a metal plate.

11. The ceiling light apparatus of claim 1, wherein the light source module comprises multiple light source units.

12. The ceiling light apparatus of claim 11, wherein each light source unit comprises an U-shape substrates mounted with LED modules.

13. The ceiling light apparatus of claim 11, wherein the base plate has clips for fixing the multiple light source units.

14. The ceiling light apparatus of claim 13, wherein the clips provide electrical connections to the driver.

15. The ceiling light apparatus of claim 11, wherein the light passing cover comprises multiple lens respectively cover the multiple light source units.

16. The ceiling light apparatus of claim 15, wherein the base plate has clips for fixing the multiple light source units and the clips are manually rotatable by a user for adjusting an output light angle of corresponding light source unit.

17. The ceiling light apparatus of claim 1, wherein the light source module is a ring shape light source.

18. The ceiling light apparatus of claim 1, further comprising a conductive layer fixed to the base plate for providing electricity connection between the driver and the light source module.

19. The ceiling light apparatus of claim 1, wherein the peripheral wall comprises an attaching connector for detachably fixing an outer decoration ring.

* * * * *